US009870878B2

(12) United States Patent
Hocine et al.

(10) Patent No.: US 9,870,878 B2
(45) Date of Patent: Jan. 16, 2018

(54) INFORMATION DISPLAY SYSTEM FOR SWITCHING DEVICE, SWITCHING DEVICE, AND METHOD

(71) Applicant: GENERAL ELECTRIC COMPANY, Schenectady, NY (US)

(72) Inventors: Malik Hocine, Plainville, CT (US); Simhadri Ramalingeswara Rao Gupta, Secunderabad (IN); Jason Edward Harmon, Plainville, CT (US); Anurag Arjundas Jivanani, Plainville, CT (US); Ashish Mishra, Plainville, CT (US); David Adam Ouellette, Plainville, CT (US); Allison Stacey Conner, New York, NY (US); Piotr Slawomir Woronkowicz, New York, NY (US); Jung Soo Park, New York, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 9 days.

(21) Appl. No.: 15/057,178

(22) Filed: Mar. 1, 2016

(65) Prior Publication Data

US 2016/0260554 A1 Sep. 8, 2016

(30) Foreign Application Priority Data

Mar. 6, 2015 (IN) ..... 1118/CHE/2015

(51) Int. Cl.
*H01H 1/64* (2006.01)
*H01H 9/02* (2006.01)
(Continued)

(52) U.S. Cl.
CPC ..... *H01H 9/16* (2013.01); *H01H 3/12* (2013.01); *H01H 71/06* (2013.01); *H01H 9/18* (2013.01); *H01H 2009/188* (2013.01)

(58) Field of Classification Search
CPC .... H01H 9/16; H01H 71/06; H01H 2009/188; H01H 9/18
See application file for complete search history.

(56) References Cited

U.S. PATENT DOCUMENTS 2,021,499 A 11/1935 Chubbuck et al.
2,095,762 A 10/1937 Peterson
(Continued)

FOREIGN PATENT DOCUMENTS

AU 2009202849 A1 2/2010
CN 1925243 A 3/2007
(Continued)

OTHER PUBLICATIONS

European Search Report and Opinion issued in connection with corresponding EP Application No. 6158423.0 dated Jul. 21, 2016.
(Continued)

*Primary Examiner* — Renee S Luebke
*Assistant Examiner* — Lheiren Mae A Caroc
(74) *Attorney, Agent, or Firm* — GE Global Patent Operation; Stephen G. Midgley

(57) ABSTRACT

An information display system for a switching device having a handle includes a cover for the switching device and a faceplate. The cover includes an opening sized to allow passage of the handle. The faceplate is configured to carry information about the switching device. The faceplate is rotatable with respect to the cover to change an orientation of the information.

16 Claims, 8 Drawing Sheets

(51) Int. Cl.

| | |
|---|---|
| ***H01H 9/16*** | (2006.01) |
| ***H01H 71/06*** | (2006.01) |
| ***H01H 3/12*** | (2006.01) |
| *H01H 9/18* | (2006.01) |

(56) References Cited

U.S. PATENT DOCUMENTS

| | | | | |
|---|---|---|---|---|
| D183,812 | S | 10/1958 | Schaus | |
| 4,204,245 | A | 5/1980 | Luke et al. | |
| 4,249,227 | A | 2/1981 | Kato et al. | |
| 4,506,121 | A | 3/1985 | Peterson et al. | |
| 5,113,043 | A | 5/1992 | Morris | |
| 5,219,070 | A | 6/1993 | Grunert et al. | |
| 5,243,314 | A | 9/1993 | Maruyama | |
| 5,362,933 | A * | 11/1994 | Kutsche | H01H 71/0228 16/376 |
| 5,416,291 | A | 5/1995 | Venzke | |
| 5,504,285 | A | 4/1996 | Castonguay et al. | |
| 5,583,330 | A | 12/1996 | Fallah et al. | |
| 6,066,817 | A | 5/2000 | Flegel | |
| 6,080,947 | A | 6/2000 | Ulerich et al. | |
| 6,100,604 | A | 8/2000 | Morroni et al. | |
| 6,278,062 | B1 | 8/2001 | Sowdon | |
| D498,212 | S | 11/2004 | Kim | |
| D499,700 | S | 12/2004 | Raabe et al. | |
| 7,071,414 | B2 | 7/2006 | Kim | |
| D547,729 | S | 7/2007 | Azzola et al. | |
| 7,616,096 | B1 | 11/2009 | Sorensen | |
| D616,832 | S | 6/2010 | Corteel | |
| 8,004,377 | B2 | 8/2011 | Brusky et al. | |
| 8,230,629 | B2 | 7/2012 | Ashby et al. | |
| D735,143 | S | 7/2015 | Huhne et al. | |
| 2005/0109597 | A1 | 5/2005 | Etscheidt et al. | |
| 2005/0258921 | A1 | 11/2005 | Puskar et al. | |
| 2007/0013380 | A1 | 1/2007 | Word | |
| 2008/0157906 | A1 | 7/2008 | Oh | |
| 2011/0056819 | A1 | 3/2011 | Bower et al. | |
| 2013/0195687 | A1 | 8/2013 | Achten et al. | |
| 2014/0130575 | A1 | 5/2014 | Webber et al. | |
| 2016/0260554 | A1 | 9/2016 | Hocine et al. | |
| 2016/0260560 | A1 | 9/2016 | Mishra et al. | |
| 2016/0260569 | A1 * | 9/2016 | Mishra | H01F 7/02 |

FOREIGN PATENT DOCUMENTS

| | | | |
|---|---|---|---|
| CN | 200995012 | Y | 12/2007 |
| DE | 19838431 | A1 | 3/2000 |
| EP | 0138513 | A2 | 4/1985 |
| EP | 0375488 | A1 | 6/1990 |
| EP | 0748015 | B1 | 10/1999 |
| FR | 2641933 | A1 | 7/1990 |
| FR | 2934094 | A1 | 1/2010 |
| WO | 2013151737 | A1 | 10/2013 |
| WO | 2013175236 | A2 | 11/2013 |

OTHER PUBLICATIONS

European Search Report and Opinion issued in connection with corresponding EP Application No. 16158398.4 dated Jul. 22, 2016.
Restriction Requirement issued in connection with Related U.S. Appl. No. 29/519,636 dated Nov. 16, 2016.
Non-Final Office Action issued in connection with Related U.S. Appl. No. 14/640,390 dated Dec. 1, 2016.
Final Office Action issued in connection with Related U.S. Appl. No. 14/640,390 dated May 17, 2017.
U.S. Appl. No. 14/640,390, filed Mar. 6, 2015, Ashish Mishra et al.
U.S. Appl. No. 29/519,636, filed Mar. 6, 2015, Hima Najmeh Khoshreza et al.

* cited by examiner

INFORMATION DISPLAY SYSTEM FOR SWITCHING DEVICE, SWITCHING DEVICE, AND METHOD

BACKGROUND OF THE INVENTION

The subject matter disclosed herein relates to switching devices, and more particularly refers to an information display for a switching device.

Circuit breakers are switching devices widely used to protect electrical lines and equipment. Circuit breakers monitor current through an electrical conductor and "trip" to open the electrical circuit and thus interrupt current flow through the circuit provided that certain predetermined criteria are met, such as an over-current condition.

Circuit breakers include identifying and instructional information to indicate various features and ratings of the breaker, in order to properly select, install, and later identify a circuit breaker. Such information includes standard minimum requirements and suggested markings deemed necessary by UL, IEC, or any other standards agency that requires information to be placed on a circuit breaker, as well as any additional information provided by circuit breaker manufacturers. While some of the information may be provided in any location except the back of the circuit breaker, other information must be visible on an installed circuit breaker with or without trims or covers removed. Information that must be visible on an installed circuit breaker, on an operator-visible portion of the breaker, is placed on a face of the circuit breaker. The reason for this requirement is that information is necessary for the correct installation of the circuit breaker, having predetermined performance ratings and criteria, based on available electrical connections and intended use. Once the installation is complete, the information on the operator-visible portion of the circuit breaker is available for subsequent inspection at an orientation in which the circuit breaker is installed.

BRIEF DESCRIPTION OF THE INVENTION

According to one aspect of the invention, an information display system for a switching device having a handle includes a cover for the switching device and a faceplate. The cover includes an opening sized to allow passage of the handle. The faceplate is configured to carry information about the switching device. The faceplate is rotatable with respect to the cover to change an orientation of the information.

According to another aspect of the invention, a switching device includes a handle, a cover, and a faceplate. The cover includes an opening, and the handle extends through the opening. The faceplate is configured to carry information about the switching device, and is rotatable with respect to the cover to change an orientation of the information.

According to yet another aspect of the invention, a method of displaying information on a switching device having a handle includes securing a faceplate to the switching device, the faceplate containing the information in a first orientation; and, rotating the faceplate with respect to the handle to reposition the information in a second orientation different than the first orientation.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
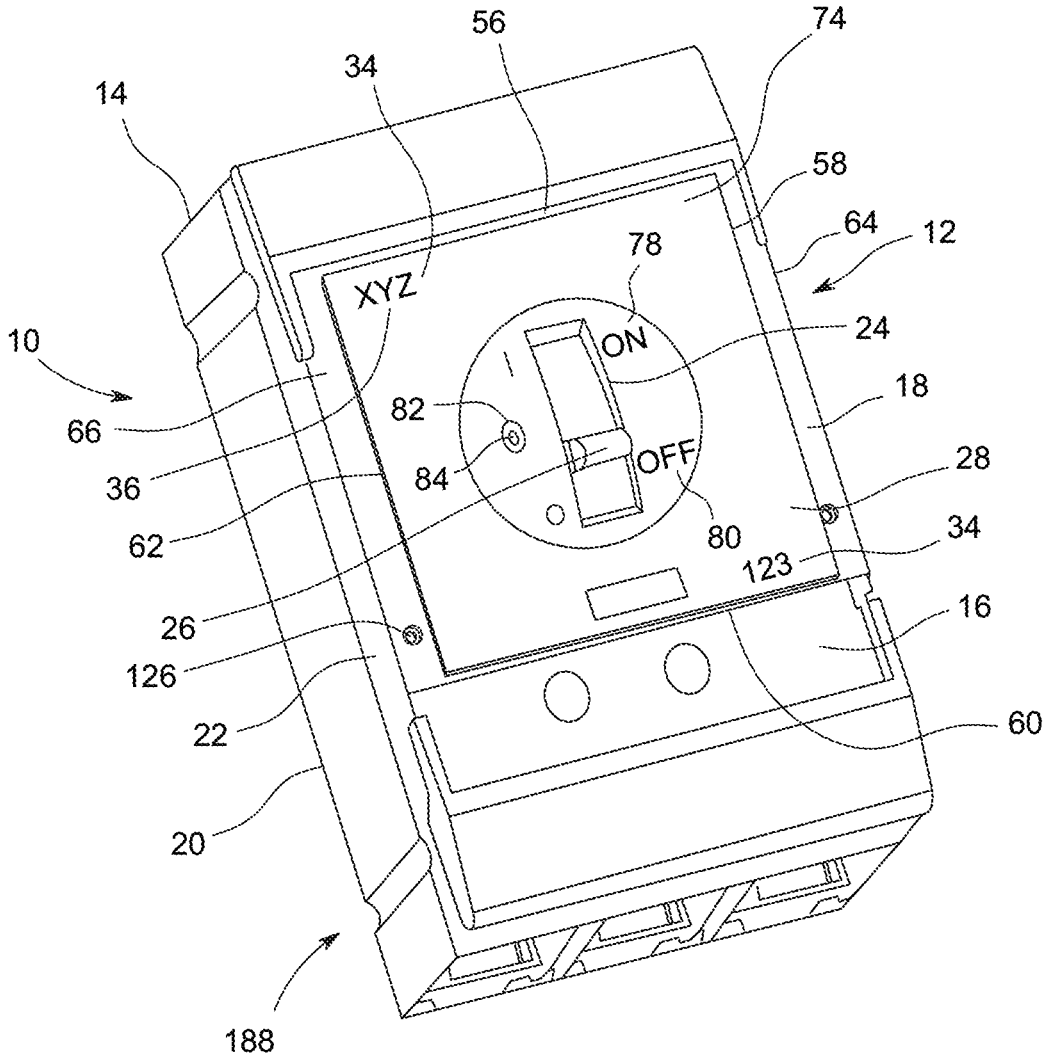
FIG. 1 is a perspective view of a switching device including an embodiment of an information display system.

FIG. 1 shows one embodiment of a switching device 10 that includes an embodiment of an information display system 12. The illustrated switching device 10 is a circuit breaker 14, although other switching devices may incorporate the information display system 12. While the circuit breaker 14 is illustrated as a 3 pole molded case circuit breaker ("MCCB") having a particular size and shape and as having available components 16 on a top cover 18, other types and sizes of circuit breakers 14 and switching devices 10 can advantageously employ the information display system 12, and the illustrated circuit breaker 14 is presented for illustrative purposes only. Also, while the circuit breaker 14 is illustrated as having a base 20 and a midcover 22 between the base 20 and cover 18, the midcover 22 and base 20 could alternatively be combined. The base 20, midcover 22, and cover 18 provide a housing 188 of the switching device 10. A handle slot 24 is provided in a fixed member 30 for allowing passage of a handle 26 of the circuit breaker 14. The cover 18 may be a separable cover for removal from the base 20, such as for inspection or repair of internal components (not shown) of the circuit breaker 14. Internal components of the circuit breaker 14 may include, but are not limited to, a contact system having a set of fixed and movable contacts, movable contact arms supporting the movable contacts, an operating mechanism operating the movable contact arms, line and load straps supporting or electrically connected to fixed contacts, a current sensing unit, and arc chamber. In a normal "on" or closed condition of the circuit breaker 14, such as when the handle 26 is moved to an opposite side of the handle slot 24, the fixed and movable contacts are physically connected to each other. In an "off" or open condition of the circuit breaker 14, such as when the handle is in the position shown in FIG. 1, the movable contacts are separated, such as via an opening spring, from the fixed contacts. The circuit breaker 14 thus makes or breaks the circuit based on current conditions, and may further carry rated current without over heating, provide adequate contact pressure and depression to keep the contacts closed in normal conditions, provide sufficient force to open the contact system with desired velocity during abnormal conditions, and provide dielectric isolation when contacts are in an open condition.

Figure 2:
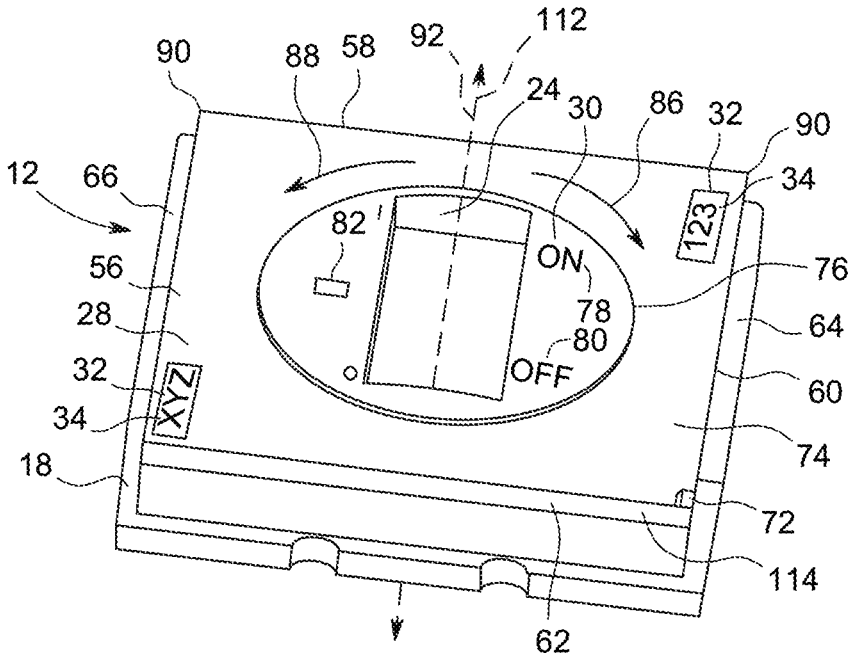
FIG. 2 is a perspective view of the information display system of FIG. 1.
Figure 3:
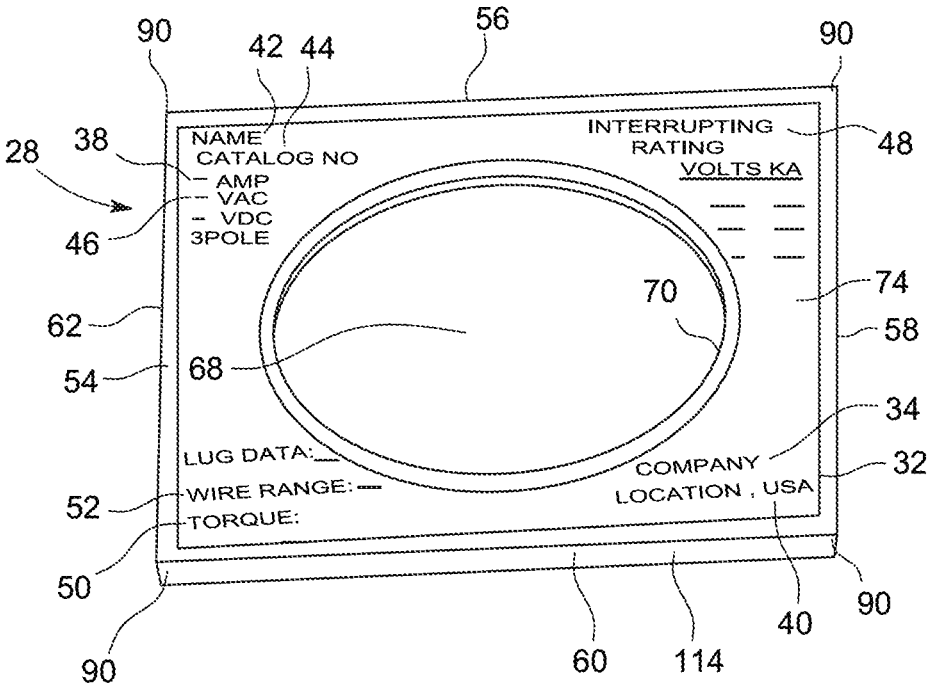
FIG. 3 is a perspective view of an exterior surface of an embodiment of a faceplate of the information display system.
Figure 11:
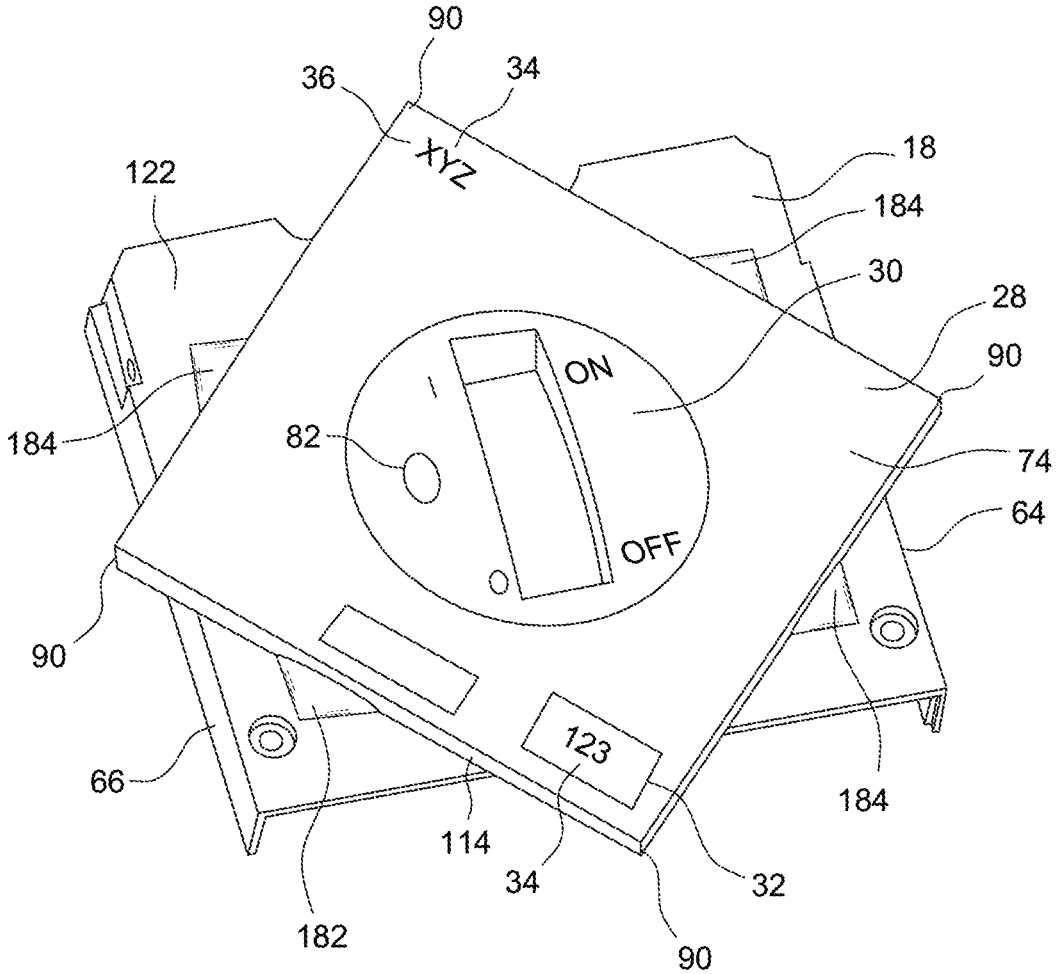
FIG. 11 is a perspective view of exterior surfaces of an alternate embodiment of the information display system; and, FIG. 12 is a perspective view of interior surfaces of the information display system of FIG. 11.

Turning now to FIG. 2, an embodiment of the information display system 12 is shown to include a faceplate 28, the cover 18 or portion of the cover of the circuit breaker 14, and the fixed member 30. The faceplate 28 is a rotatable information carrier. The faceplate 28 may be configured to support one or more labels 32 as shown in FIGS. 2, 3, and 11, having the information 34, such as but not limited to an adhesive label, or alternatively the faceplate 28 may include information 34 provided directly thereon, such as printed, inscribed, stamped, or etched on the faceplate 28 such as in areas 36, as demonstrated by FIGS. 1 and 11. In yet another alternative embodiment, the faceplate 28 may include a combination of one or more labels 32 and information 34 provided directly on the faceplate 28, such as demonstrated by FIG. 11. The information 34 provided on the faceplate 28 contains information about the switching device 10 used for operation, installation and inspection of the switching device 10. With reference to FIG. 3, as applicable, when the switching device 10 is a circuit breaker 14, information 34 provided on the faceplate 28 for the circuit breaker 14 may include, but is not limited to, ampere rating 38, manufacturer identification 40, breaker type designation 42, a catalog number 44, voltage rating 46, SWD designation, HID designation, maximum ambient temperature in which the circuit breaker can be applied, Class CTL (circuit limiting), line and load designation, interrupting ratings 48, termination (Cu—Al wire), tightening torque 50, wire temperature ratings 52, maximum wire size, 100% rating marking, and fault protection information (ground fault protection for people GFCI, ground fault protection for equipment GFPE, and arc-fault protection AFCI), some of which is shown in FIG. 3 for illustrative purposes. In addition to data and details regarding the switching device 10, installation and operating instructions, company trademarks, safety information, scannable code, agency certification information, and any other relevant information may be provided as the information 34 on the faceplate 28. The information 34 may be fixed in orientation with respect to the faceplate 28. That is, as the faceplate 28 rotates, so does the information 34.

In an embodiment of the faceplate 28, the faceplate 28 includes a square-shaped outer periphery 54 having outer peripheral edges 56, 58, 60, 62 and a width that may be substantially the same as a width of the cover 18, measured from two opposite sides 64, 66 of the cover 18, however different widths of the faceplate 28 may also be accommodated. The faceplate 28 includes an opening 68 having an inner periphery 70 that may be at least substantially circular, and a diameter of the inner periphery 70 may be approximately the same as an outer diameter of the fixed member 30, although differences in diameter between the inner periphery 70 of the faceplate 28 and the outer diameter of an outer periphery 76 of the fixed member 30 may be made for clearance and relative positioning purposes, and the outer diameter of the fixed member 30 may vary depending on the longitudinal location of the fixed member 30 in which the outer diameter is measured, as will be further described below. The faceplate 28 includes a thickness that may be selected to allow grasping by an operator. Alternatively, or additionally, the faceplate 28 may include one or more easily graspable protrusions 72 (FIG. 2) extending from edges 56, 58, 60, 62 of the faceplate 28 or from an exterior surface 74 of the faceplate 28, although such protrusions 72 should not interfere with the provision of an information-containing label 32 or information 34 provided directly on the faceplate 28.

The fixed member 30 includes the handle slot 24 that may be substantially rectangular shaped, however any size aperture that allows the handle 26 to move from an on to an off position of the circuit breaker 14 can be provided as the handle slot 24. On-off indicators 78, 80 may be provided on the fixed member 30 adjacent the handle slot 24. An embodiment of the fixed member 30 further includes a circular, or at least substantially circular, outer periphery 76. As noted above, the outer periphery 76 may have approximately the same diameter as that of the inner periphery 70 of the faceplate 28. The fixed member 30 may further include a push-to-trip button hole 82 to access a push-to-trip button 84 (FIG. 1), such as to test the circuit breaker 14 mechanically. The fixed member 30 is rotationally fixed with respect to the cover 18, and therefore, while the fixed member 30 is described herein as a separate element from the cover 18 to ease in assembly, in some embodiments, the fixed member 30 may be integrally combined with the cover 18. As the faceplate 28 is rotated with respect to the cover 18, the faceplate 28 rotates with respect to both the fixed member 30 and the cover 18 simultaneously. For reduction of parts, the cover 18 of the information display system 12 shown in FIG. 1 may be the same cover of the switching device 10 of FIG. 1. While only a square portion of the cover 18 is shown in FIG. 2, the cover 18 may take on any lengths necessary to properly cover a base 20 and contain internal components of the switching device 10, including the rectangular cover shape shown in FIG. 1. Alternatively, a cover 18 of a switching device 10 may include the square portion shown in FIG. 2 and additional portions as needed to form a whole cover for the switching device 10. In yet another alternative embodiment, the information display system 12 of FIG. 2 may be added to an existing cover of a switching device 10.

With reference to FIG. 2, in an embodiment of the information display system 12, the faceplate 28 may be turned in either a clockwise direction 86 or a counterclockwise direction 88 with respect to the fixed member 30 and cover 18. As can be readily appreciated, the ability to rotate the faceplate 28 provides an installer and operator with the opportunity to turn the faceplate 28 to an orientation that provides the installer and operator greatest ease in reading the information 34 contained on the faceplate 28, regardless of the orientation of the remainder of the installed switching device 10. For demonstrative purposes only, information 34 on the faceplate 28 shown in FIG. 1 is in a first orientation, while the same information 34 is shown in FIG. 2 in a second orientation, different than the first orientation, due to rotation of the faceplate 28 with respect to the cover 18 and fixed member 30. The illustrated second orientation is 90 degrees counterclockwise from the first orientation, or 270 degrees clockwise from the first orientation. While the ability to rotate in both clockwise direction 86 and counterclockwise direction 88 provides the greatest flexibility to the operator and installer, the information display system 12 may instead be designed such that the faceplate 28 can only rotate in either the clockwise direction 86 or counter-clockwise direction 88.

Figure 12:
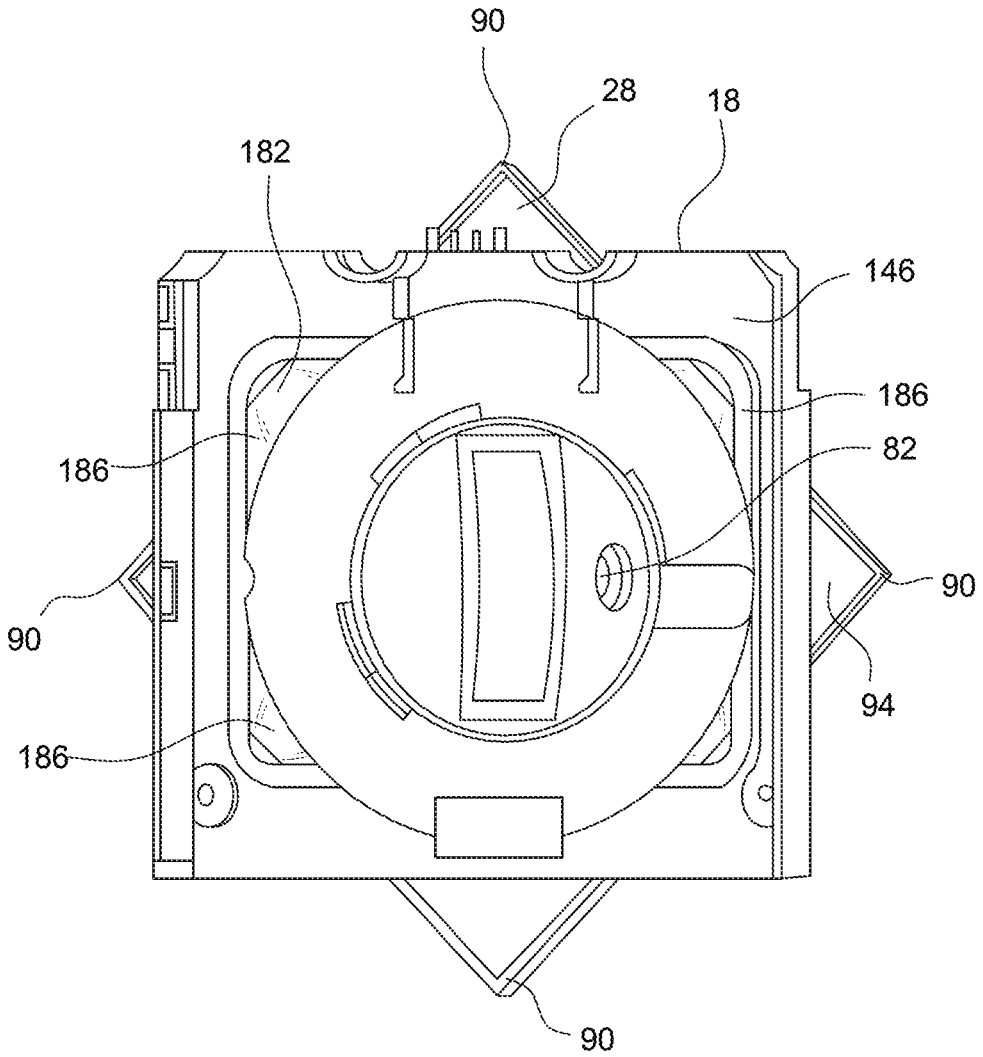

Further, with respect to rotation of the faceplate 28, the faceplate 28 may include features, as will be further described below, that limit repositioning of the faceplate 28 on the cover 18 to a selected number of rest positions, such as four rest positions at 90 degree increments. By limiting rest positions to 90 degree increments, at least two of the outer peripheral edges, either opposite edges 58 and 62 or opposite edges 56 and 60, of the faceplate 28 remain aligned and substantially parallel with opposite sides 64, 66 of the switching device 10, as shown in FIG. 1. For example, in a first rest position, such as shown in FIG. 1, edge 58 of faceplate 28 is adjacent side 64 of cover 18, in a second rest position, such as shown in FIG. 2, edge 60 of faceplate 28 is adjacent side 64 of cover, in a third rest position, edge 62 would be adjacent side 64 of cover 18, and in a fourth rest position, edge 56 would be adjacent side 64 of cover 18. In a non-rest position, such as shown in FIGS. 11 and 12, while rotating the faceplate 28 from one rest position to the next, corners 90 of the faceplate 28 may protrude outwardly from the opposite sides 64, 66 of the switching device 10. The rest positions avoid this by aligning the outer peripheral edges 56 and 60 or 58 and 62 with opposite sides 64, 66 of the switching device 10 when the features are aligned at any of the rest positions of the faceplate 28. While a square faceplate 28 has been described, the faceplate 28 may include any number of outer peripheral edges with corresponding additional features to limit repositioning to a greater number of rest positions. For example, the faceplate 28 may include an octagonally shaped outer periphery (not shown) and features may limit repositioning to every 45 degrees, and thus such an embodiment would increase the number of possible rest positions for the faceplate to eight while still aligning two edges of the faceplate 28 with opposite sides 64, 66 of the switching device 10. The information display system 12 is not limited with respect to a particular number of rest positions or number of outer peripheral edges of the faceplate 28. Although not conventional, the faceplate 28 may even include rounded outer peripheral edges, and while the faceplate 28 has been described as having an outer periphery 54 that may be square or octagonal which has advantages in aligning with sides 64, 66 of the cover 18, it should be understood that the shape of the faceplate 28 is not limited herein, and could alternatively be round, triangular, or other shape deemed aesthetically pleasing and suitable to contain the information 34. In any case, the orientation of the information 34 provided on the faceplate 28 is alterable to ease a user's review of the information 34.

For the purposes of description of one embodiment of the faceplate 28 herein, the faceplate 28 will be described as having resting positions at 90 degree increments. Multiples of a 90 degree rotation of the faceplate 28 with respect to the cover 18 reposition the faceplate 28 to accommodate horizontal and vertical installation orientations of the switching device 10 in a switching device panel. Manually turning the faceplate 28 of the switching device 10 90 degrees in either direction 86, 88, or 180 degrees clockwise or counter clockwise around a longitudinal axis 92 of the fixed member 30 (extending into FIG. 2 and about a center point of faceplate 28) reorients the information 34 to match the installation orientation. This rotation will be powered by the user and is facilitated by mechanical features under the faceplate 28 that correspond with at least one of the cover 18 and the fixed member 30. With this rotatable faceplate 28, the installer and user can adopt the information orientation to both vertical and horizontal installations and retrieving information 34 from the label 32 and faceplate 28 becomes user friendly.

Figure 4:
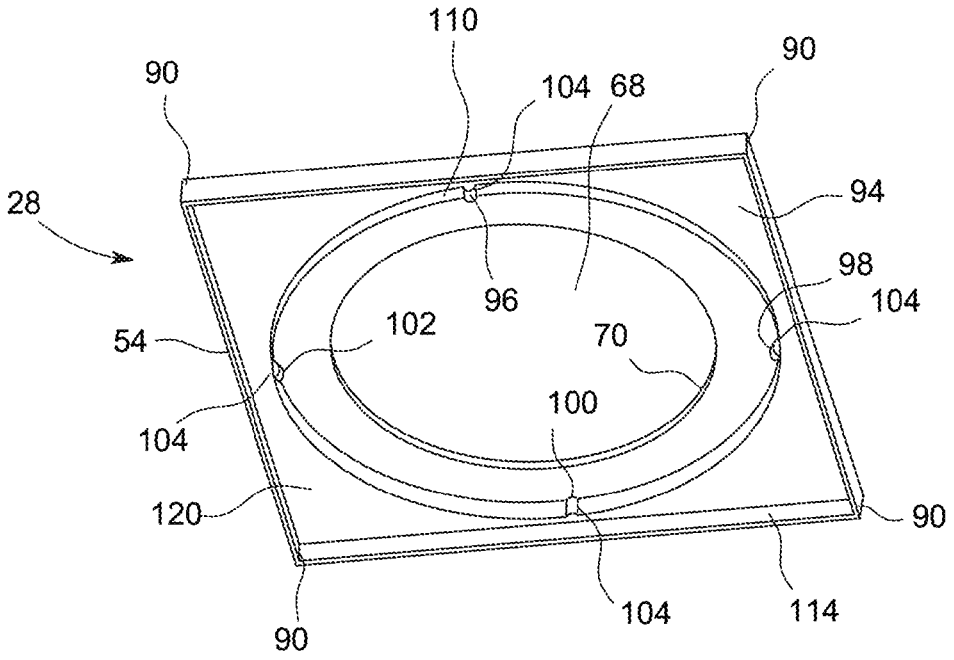
FIG. 4 is a perspective view of an interior surface of the faceplate of FIG. 3.

The interior surface 94, opposite the exterior surface 74, of the faceplate 28 is depicted in FIG. 4. The faceplate 28 includes the opening 68 with the inner periphery 70 having at least a substantially circular shape. In one embodiment, the faceplate 28 may further include an interior ledge 110, having a substantially circular shape as shown, provided on the interior surface 94, and operatively arranged for guiding movement of the faceplate 28 with respect to the cover 18. In the illustrated embodiment, the interior ledge 110 is disposed radially outwardly of the inner periphery 70, that is, further from a central axis of rotation 112 of the faceplate 28, which coincides with a longitudinal axis 92 of the fixed member 30, as shown in FIG. 2. The interior ledge 110 extends from the interior surface 94, such as substantially perpendicular from the interior surface 94, although in alternate embodiments the interior ledge 110 may extend at different non-zero angles from the interior surface 94. The faceplate 28 further includes an outer ledge 114 extending from the interior surface 94, and spaced outwardly from the interior ledge 110. The outer ledge 114 may extend along the outer periphery 54 of the faceplate 28 as shown. The interior ledge 110 and the outer ledge 114 may have a uniform height, and in an alternative embodiment any of the spaces 120 defined between the interior surface 94, interior ledge 110, and outer ledge 114 may be filled in with material, such as the same material used to form the faceplate 28, including but not limited to plastic. Also alternatively, the interior surface 94 may be provided with any arrangement of webs or support structure necessary to promote structural stability of the faceplate 28.

The interior ledge 110 includes first features 104 operatively arranged to provide the rest positions of the faceplate 28 with respect to the cover 18 and fixed member 30. In one embodiment, the first features 104 are provided on a radially inward side of the interior ledge 110. In the illustrated embodiment, the first features 104 include first, second, third, and fourth protrusions 96, 98, 100, 102 that are spaced 90 degrees apart from each other, such as at 12 o'clock, 3 o'clock, 6 o'clock, and 9 o'clock positions on the interior surface 94 of the faceplate 28. The first features 104 protrude from the radially inward side of the interior ledge 110, and extend radially inwardly from the interior ledge 110 towards the inner periphery 70. The first features 104 may alternatively be detents indented in the interior ledge 110 and extend radially outwardly from the interior ledge 110. The first features 104 may also be provided on alternate locations of the faceplate 28 to correspond with features of at least one of the cover 18 and the fixed member 30.

Figure 5:
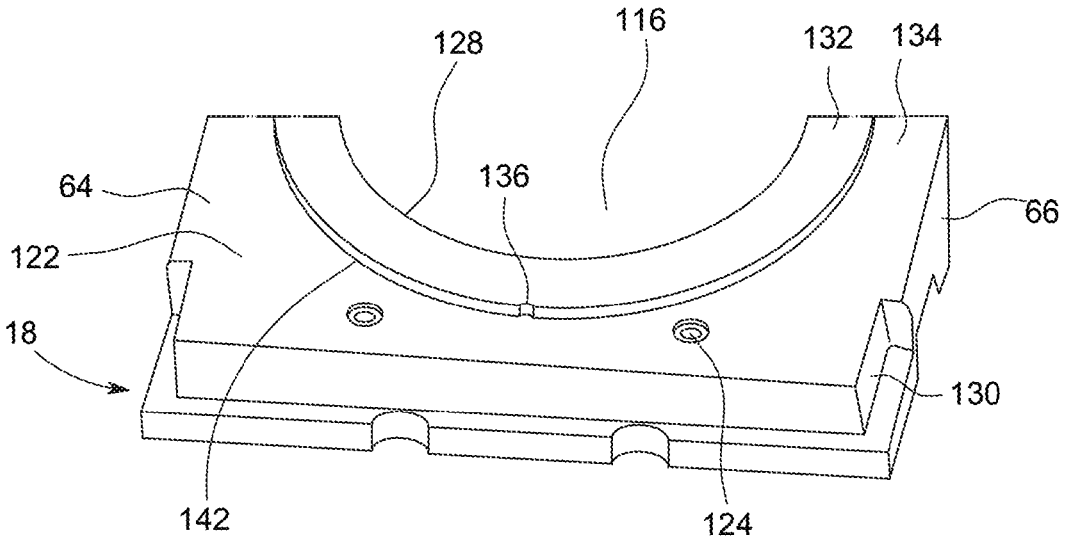
FIG. 5 is a perspective view of a portion of an exterior surface of an embodiment of a cover of the information display system.
Figure 6:
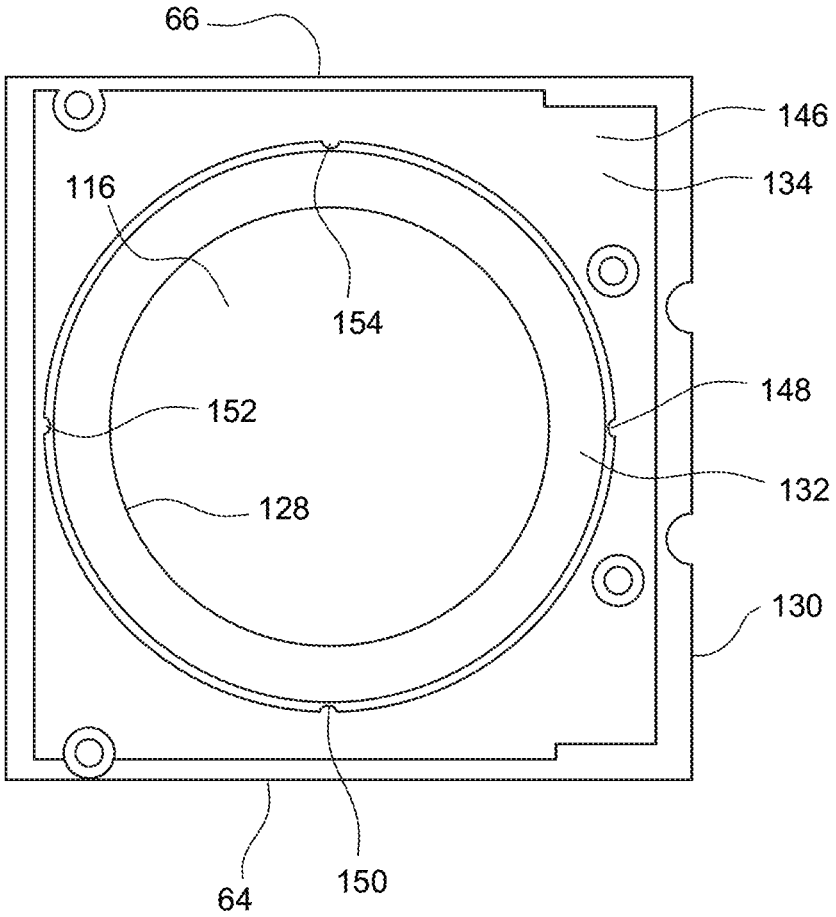
FIG. 6 is a plan view of an interior surface of the cover of FIG. 5.
Figure 10:
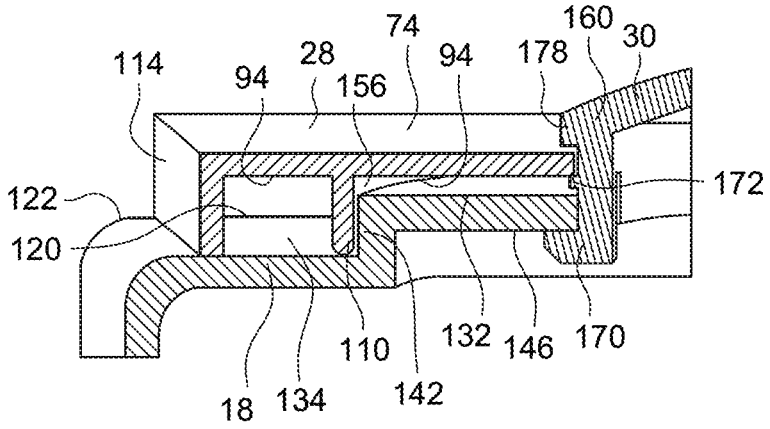
FIG. 10 is sectional view of a portion of the information display system.

An exterior surface 122 of the cover 18 is shown in FIG. 5, while an interior surface 146 of the cover 18 is shown in FIG. 6. The cover 18 may include holes 124 for securement devices 126 (FIG. 1), such as screws, to be passed therethrough in order to secure the cover 18 to the base 20 (or to the mid cover 22, or to another cover) of the switching device 10. When assembled, the interior surface 94 of the faceplate 28 faces the exterior surface 122 of the cover 18, and the interior ledge 110 and outer ledge 114 of the faceplate 28 extend towards the cover 18 (see FIG. 10). The cover 18 includes an inner periphery 128, which may have a substantially circular opening 116 for passing the fixed member 30 therethrough, which will be further described below, and in turn the opening 116 provides a passage for the handle 26. The cover 18 further includes an outer periphery 130 having first and second opposite sides 64, 66. The cover 18 may include a first portion 132 and a second portion 134, the first portion adjacent the inner periphery 128 and the second portion 134 surrounding the first portion 132. The first and second portions 132, 134 may be substantially planar as shown in FIGS. 5 and 10, but may include other surfaces. As will be further described below with respect to FIGS. 11 and 12, the second portion 134 may alternatively include ramped surfaces 182.

The cover 18 further includes a shoulder wall 142 spaced radially outwardly from the inner periphery 128. The shoulder wall 142 extends from the second portion 134 of the cover 18, such as substantially perpendicular to the first and second portions 132, 134, although in alternate embodiments the shoulder wall 142 may extend at other non-zero angles that complement the angle of the interior ledge 110. The shoulder wall 142 may be substantially cylindrically shaped and may at least substantially correspond in size with an inner periphery of the interior ledge 110. That is, the first shoulder wall 142 may have a diameter substantially the same as the diameter of the inner periphery of the interior ledge 110, although the diameter of the shoulder wall 142 may be smaller than the diameter of the inner periphery of the interior ledge 110 of the faceplate 28 to provide clearance for the interior ledge 110 to overlap the shoulder wall 142 during assembly and rotation of the faceplate 28 with respect to the cover 18. The shoulder wall 142 includes second features 136 on a radially outward surface of the shoulder wall 142. In the illustrated embodiment, the second features 136 include first, second, third, and fourth detents 148, 150, 152, and 154 (see FIG. 6) that are spaced 90 degrees apart from each other, at 12 o'clock, 3 o'clock, 6 o'clock, and 9 o'clock positions of the cover 18. While the second features 136 may be detents that are indented into the shoulder wall 142 and extend radially inwardly from the shoulder wall 142, alternatively the second features 136 may be protrusions that extend radially outwardly from the shoulder wall 142. The second features 136 may also be a combination of detents and protrusions. The second features 136 are sized to correspond and mate with the first features 104 on the interior ledge 110 of the faceplate 28. For example, if the first feature 104 is a protrusion as shown, then the second feature 136 is a detent sized to accept the protrusion 104 therein as shown schematically in FIG. 9. The outer diameter of the shoulder wall 142 and the inner diameter of the interior ledge 110 may be substantially the same, such that when the first features 104 are moved from the second features 136, the faceplate 28 is out of sync with the cover 18 until the first features 104 and the second features 136 are again re-aligned, at which point a tangible snap, and in some embodiments even an audible snap, may be felt and heard by the user rotating the faceplate 28. The first portion 132 of the exterior surface 122 of the cover 18 between the shoulder wall 142 and the inner periphery 128 of the cover 18 is offset from the second portion 134 of the exterior surface 122 of the cover 18 between the shoulder wall 142 and the outer periphery 130 of the cover 18. When assembled as shown in FIG. 10, the first portion 132 of the cover 18 is positioned closer to the interior surface 94 of the faceplate 28 than the second portion 134 of the cover 18, although a clearance gap 156 (FIG. 10) may be provided between the faceplate 28 and the first portion 132 of the cover 18 for easing rotation therebetween. The cover 132 may further include one or more third features 158 at the inner periphery 128 of the cover 18 for engaging with the fixed member 30 as will be further described below. In an embodiment of the third feature 158, the third feature 158 may be a detent as shown, but may alternatively be a protrusion.

Figure 7:
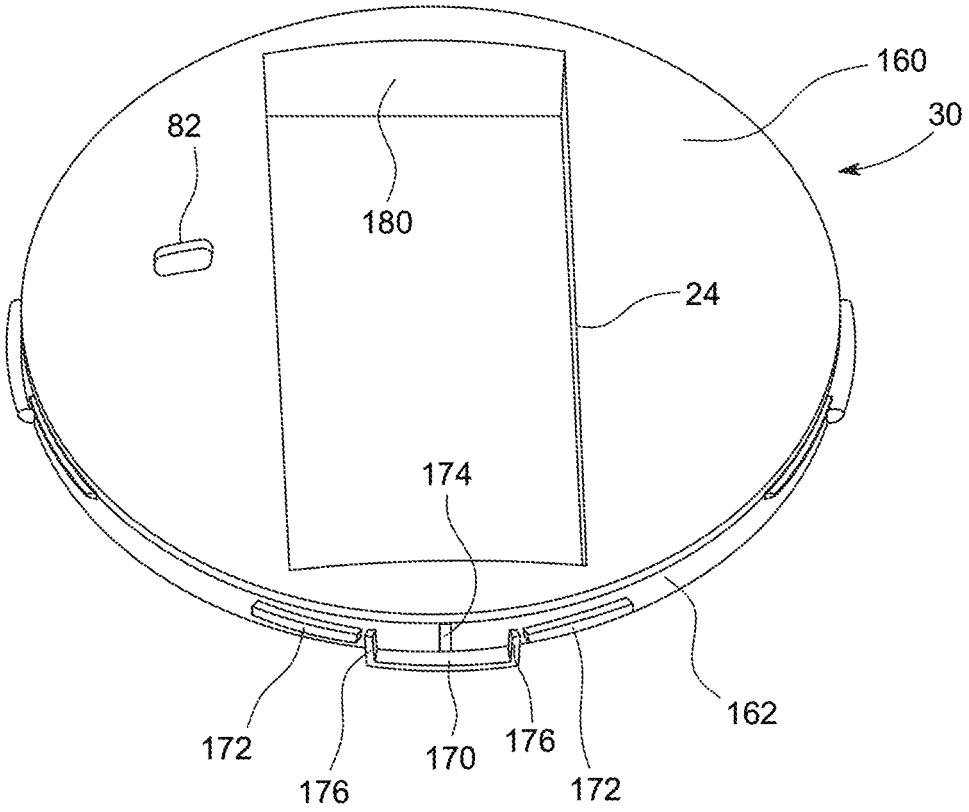
FIG. 7 is perspective view of an exterior surface of a fixed member of the information display system.
Figure 8:
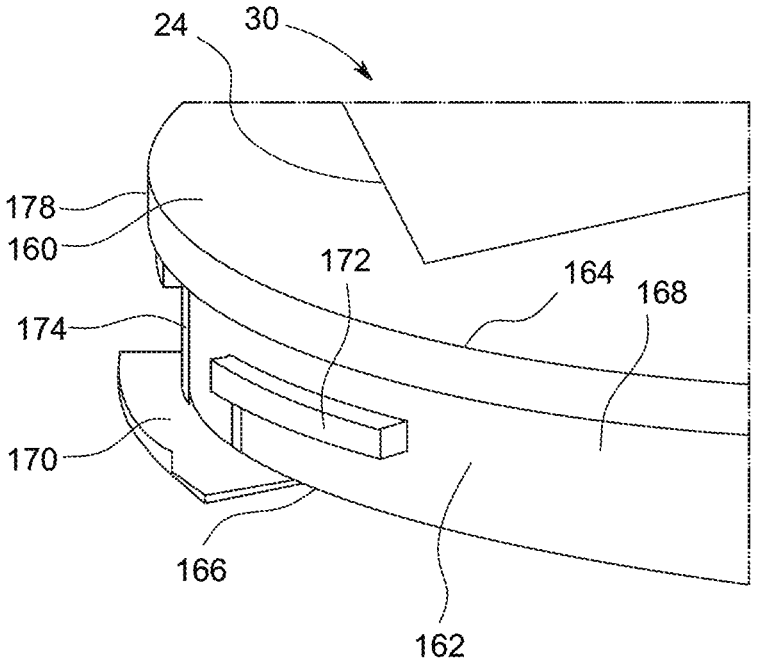
FIG. 8 is a perspective view of a portion of the fixed member of FIG. 7.
Figure 9:
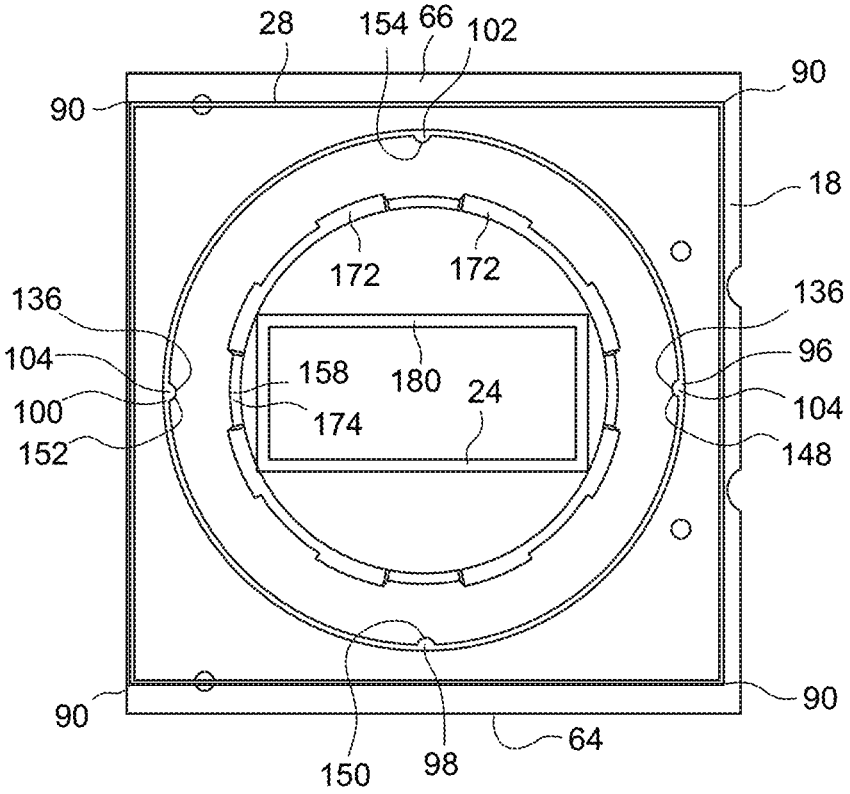
FIG. 9 is a schematic plan view of an interior of the information display system.

An embodiment of the fixed member 30 is shown in FIGS. 7 and 8. The fixed member 30 includes a slotted surface 160 through which the handle slot 24 extends. The slotted surface 160 may further include the push-to-trip button hole 82. While the slotted surface 160 is depicted as a dome or substantially dome-shaped surface, the slotted surface 160 may alternatively be planar or substantially planar. The fixed member 30 may further include a sidewall 162, which may have a substantially cylindrical shape such as a tubular portion, extending from the slotted surface 160, with an inner end 164 at the slotted surface 160, and an outer end 166. The longitudinal axis 92 of the sidewall 162 of the fixed member 30 may also align with and serve as the axis of rotation 112 of the faceplate 28. A radially outer surface 168 of the sidewall 162 includes a number of components to engage with the faceplate 28 and the cover 18 to form the information display system 12 by securing the faceplate 28 relative to the cover 18, allowing rotatability between the faceplate 28 and cover 18, and fixing the cover 18 relative to the fixed member 30. Such components include, but are not limited to, tabs 170, locking features 172, and glands 174. The tabs 170 extend from the outer end 166 of the sidewall 162, and are engageable with the interior surface 146 of the first portion 132 of the cover 18 (see FIG. 10). The tabs 170 may have some flexibility in a radial direction due to longitudinal cutouts 176 to assist in securing the fixed member 30 to the faceplate 28 and then to the cover 18. In one embodiment, four tabs 170 are provided, spaced 90 degrees apart from each other, although an alternate number of tabs 170 may be provided. The locking features 172 are shown to protrude radially outwardly from the sidewall 162 and between the slotted surface 160 and the outer end 166 of the sidewall 162. In one embodiment, a locking feature 172 is provided on opposite sides of each tab 170. The locking feature 172 is sized to space the first portion 132 of the exterior surface 122 of the cover 18 from the interior surface 94 of the faceplate 28 (see FIG. 10). As shown in FIGS. 8 and 9, the glands 174 extend longitudinally along the tabs 170 and engage with the third features 158 of the cover 18 to prevent, or at least substantially prevent, rotation between the cover 18 and the fixed member 30. The fixed member 30 may further include a lip 178, most clearly shown in FIG. 10, protruding the slotted surface 160 radially outwardly beyond an outer diameter of the radially outer surface 168 of the sidewall 162. While the lip 178 is illustrated as extending from an entire periphery of the slotted surface 160, the lip 178 may include any number of interruptions therein, such that the lip 178 may include a set of lips radially distributed about the periphery of the slotted surface 160. The faceplate 28 is positionable between the lip 178 and the locking features 172. A clearance gap may be provided between the exterior surface 74 of the faceplate 28 and the lip 178 in order to assist in the rotatability of the faceplate 28 with respect to the fixed member 30. Walls 180 may extend from the handle slot 24 within the sidewall 162 to surround the handle 26 that extends therethrough.

The faceplate 28, fixed member 30, and cover 18 may each be formed of a durable plastic material that affords some flexibility between the cooperating features 104, 136. To assemble the information display system 12, the faceplate 28 may be snapped into the fixed member 30 between the lip 178 and the locking feature 172 by inserting the sidewall 162 into the opening 68 in the faceplate 28, where the tabs 170 flex inwardly during insertion of the sidewall 162 into the opening 68, and flex back outwardly to their biased condition after insertion. Then, the fixed member 30, with the faceplate 28 secured thereto, may be snapped into the opening 116 of the cover 18 using the tabs 170 and glands 174 to position the faceplate 28 onto the cover 18 with the interior ledge 110 of the faceplate 28 surrounding the shoulder wall 142 of the cover 18, and the first and second features 104, 136 engaged with each other. While tabs 170 have been described, the fixed member 30 may be fixedly secured to the cover 18 using alternative methods of securement. For example, the fixed member 30 may be laser welded or ultrasonically welded to the cover 18. In this assembled condition, the faceplate 28 overlaps at least a portion of the cover 18, such as portions of first and second portions 132, 134, and the lip 178 overlaps at least a portion of the faceplate 28, substantially axially trapping the faceplate 28 between the cover 18 and the lip 178, although a small amount of movement may be permitted for clearance purposes and to reduce friction during rotation. A method of displaying the information 34 on the switching device 10, which is an electrical device such as a circuit breaker 14, includes securing the faceplate 28 to the switching device 10, such as by securing the faceplate 28 to a cover 18 of a housing 188 of the circuit breaker 14 and attaching the cover 18 with the faceplate 28 to a base 20 of the housing 188 of the circuit breaker 14. The faceplate 28 is thus secured within the information display system 12 due to cooperating mechanical features between the cover 18, fixed member 30, and faceplate 28, yet rotatable with respect to the cover 18 and fixed member 30. The information 34 may be placed on the faceplate 28 at any point during the assembly of the faceplate 28, fixed member 30, and cover 18.

Different installation orientations of a switching device 10 can render a conventional fixed label inconvenient to read or scan. When a switching device is installed, the fixed labels could be facing up, down, right or left with respect to an operator's field of vision from a normal standing, leaning, or sitting position of the operator, and as a result the operator may have some difficult reading the label if it is not installed in a manner that allows reading in a manner with which the language of information 34 is intended to be read, e.g. from left to right, left to right, and/or top to bottom. Thus, the information display system 12 provides a user with the opportunity to rotate the faceplate 28 with respect to the cover 18 and fixed member 30, which are fixed in relation to a remainder of the switching device 10, including the fixed orientation of the handle 26. Due to the inherent flexibility of the material, the first features 104 on the interior ledge 110 of the faceplate 28 may be moved away from the second features 136 on the shoulder wall 142 of the cover 18 with relatively little force in either the clockwise or counterclockwise directions 86, 88, allowing the faceplate 28 to be rotated to a desired orientation. The first features 104 will again align with the second features 136 when the desired orientation is selected such that the faceplate 28 cannot spin around inadvertently with respect to the cover 18. The first and second features 104, 136 are aligned in the rest positions of the information display system 12, and misaligned in the non-rest positions of the information display system 12.

An alternate embodiment of the information display system 12 is shown in FIGS. 11 and 12. In lieu of a substantially planar second portion 134, the second portion 134 of the cover 18 includes a ramped surface 182 including ramps 184 which protrude outwardly from the exterior surface 122 of the cover 18. In other words, the ramped surface 182 bulges outwardly, and is positioned closer to the faceplate 28 in an assembled condition of the information display system 12 than the second portion 134. The ramps 184 may gradually increase a height of the cover 18 from the second portion 134 to the first portion 132. The interior surface 146 of the cover 18 is correspondingly indented at indents 186 at the location of the ramps 184. Because the faceplate 28 rotates over the cover 18, the outer ledge 114 of the faceplate 28 will ride along the ramps 184 during rotation and encourage the faceplate 28 to return to a rest position. Also, because there is a minimum amount of space within the housing 188 of the switching device 10 for all of the operating components of the switching device 10, the indents 186 provide additional room for accessories mounted below the cover 18. In other words, the ramped surface 182, including ramps 184 and indents 186, eliminates wasted space within the housing 188 of the switching device 10.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An information display system for a switching device, the switching device having a handle, the information display system comprising:

a cover for the switching device, the cover including an opening sized to allow passage of the handle; and, a faceplate configured to carry information about the switching device;

a fixed member having a slotted surface and a sidewall, the slotted surface including a slot sized to allow passage of the handle therethrough, the fixed member rotationally fixed with respect to the cover;

wherein the faceplate is rotatable with respect to the cover to change an orientation of the information.

2. The information display system as claimed in claim 1, wherein the faceplate includes the information.

3. The information display system as claimed in claim 1, wherein the sidewall includes an inner end at the slotted surface and an outer end, the sidewall further including at least one tab at the outer end, the at least one tab operatively engaged with the cover to secure the fixed member to the cover.

4. The information display system as claimed in claim 1, wherein the sidewall includes a feature cooperatively engaged with the cover to prevent relative rotation between the fixed member and the cover.

5. The information display system as claimed in claim 1, wherein the fixed member includes a lip, the faceplate axially trapped between the lip and the cover.

6. The information display system as claimed in claim 1, wherein the faceplate is rotatable in both clockwise and counterclockwise directions with respect to the cover.

7. An information display system for a switching device, the switching device having a handle, the information display system comprising:

a cover for the switching device, the cover including an opening sized to allow passage of the handle; and, a faceplate configured to carry information about the switching device;

wherein the faceplate is rotatable with respect to the cover to change an orientation of the information, and wherein the faceplate and the cover include cooperating features to urge the faceplate to rest at any one of a plurality of rest positions with respect to the cover.

8. The information display system as claimed in claim 7, wherein each rest position amongst the plurality of rest positions is spaced 90 degrees apart in either a clockwise or counterclockwise direction from an adjacent rest position.

9. The information display system as claimed in claim 7, wherein the faceplate includes a plurality of first features and the cover includes a plurality of second features, the plurality of first features engageable with the plurality of second features when the faceplate is in any one of a plurality of rest positions with respect to the cover.

10. The information display system as claimed in claim 9, wherein the faceplate includes a plurality of outer peripheral edges and the cover has first and second opposite side edges, and, when the faceplate is in any one of the plurality of rest positions, two of the outer peripheral edges of the faceplate are substantially parallel to the first and second opposite side edges of the cover.

11. The information display system as claimed in claim 9, wherein the faceplate further includes an interior surface arranged to face the cover, and a ledge extended from the interior surface of the faceplate, and the cover further includes an exterior surface arranged to face the faceplate, and a shoulder wall, the first features located on the ledge and the second features located on the shoulder wall.

12. The information display system as claimed in claim 9, wherein the first features and the second features include cooperative protrusions and detents.

13. An information display system for a switching device, the switching device having a handle, the information display system comprising:

a cover for the switching device, the cover including an opening sized to allow passage of the handle; and, a faceplate configured to carry information about the switching device;

wherein the faceplate is rotatable with respect to the cover to change an orientation of the information, and wherein the cover includes an exterior surface, the exterior surface including a plurality of ramps that protrude towards the faceplate, and the faceplate includes a plurality of outer peripheral edges that ride over the plurality of ramps during rotation of the faceplate with respect to the cover.

14. A switching device comprising:

a handle;

a cover including an opening, the handle extended through the opening; and, a faceplate configured to carry information about the switching device;

further comprising a fixed member rotationally fixed with respect to the cover, the fixed member defining a slot, the handle extended therethrough, wherein the faceplate is rotatable with respect to the cover to change an orientation of the information.

15. The switching device as claimed in claim 14, wherein the faceplate includes first features and a plurality of outer peripheral edges and the cover includes second features and first and second opposite side edges, and two of the plurality of outer peripheral edges are arranged to extend substantially parallel to the first and second opposite side edges when the first features are engaged with the second features.

16. A switching device comprising:

a handle;

a cover including an opening, the handle extended through the opening; and, a faceplate configured to carry information about the switching device;

wherein the faceplate is rotatable with respect to the cover to change an orientation of the information, and, wherein the cover includes an exterior surface, the exterior surface including a plurality of ramps that protrude towards the faceplate, and the faceplate includes a plurality of outer peripheral edges that ride over the plurality of ramps during rotation of the faceplate with respect to the cover.

* * * * *